United States Patent [19]

Andis

[11] Patent Number: 4,989,324

[45] Date of Patent: Feb. 5, 1991

[54] HAIR CLIPPER BLADE SET

[75] Inventor: Matthew L. Andis, Racine, Wis.

[73] Assignee: Andis Company, Racine, Wis.

[21] Appl. No.: 350,158

[22] Filed: May 11, 1989

[51] Int. Cl.[5] ..... B26B 19/02; B26B 19/04; B26B 19/00; B26B 19/12

[52] U.S. Cl. ..... 30/216; 30/90; 30/221; 30/222

[58] Field of Search ..... 30/216, 220, 221, 90, 30/222, 223; 310/47

[56] References Cited

U.S. PATENT DOCUMENTS

| | | | |
|---|---|---|---|
| 2,098,180 | 11/1937 | Dilks | 30/221 |
| 2,651,107 | 9/1953 | Bartlett | 30/221 |
| 2,928,171 | 3/1960 | Oster | 30/221 |
| 3,992,778 | 11/1976 | Urbush | 30/216 |
| 4,144,040 | 3/1979 | Buchholz | 30/221 |
| 4,458,417 | 7/1984 | Andis | 30/221 |

*Primary Examiner*—Douglas D. Watts
*Assistant Examiner*—Paul M. Heyrana, Sr.
*Attorney, Agent, or Firm*—Michael, Best & Friedrich

[57] ABSTRACT

Disclosed herein is a hair clipper blade set comprising a lower blade including a forward edge with a series of teeth extending therealong, upper and lower surfaces extending from said forward edge, and a threaded bore extending between the upper and lower surfaces, a movable upper blade including a forward edge with a series of teeth extending therealong, an upper surface, and a lower surface supported by the upper surface of the lower blade, a spring member for supporting and biasing the upper blade against the lower blade for linear movement of the forward edge of the upper blade parallel to the forward edge of the lower blade, which spring member comprises a forward portion including a forward end positionable against the upper surface of the movable blade, and a rear portion parallel to and spaced apart from the upper surface of the lower blade behind the movable upper blade and having therein an aperture, and a tension adjustment screw extending through the aperture, having an enlarged head engaging the spring member, and having an outer end releasably secured in the threaded bore, and further including, in the outer end, a recess facilitating rotation of the screw in the bore by manipulating a tool removably extending into the bore from the lower surface of the lower blade.

5 Claims, 2 Drawing Sheets

HAIR CLIPPER BLADE SET

BACKGROUND OF THE INVENTION

The invention relates generally to hair clippers and to electrically operated hair clippers. More particularly, the invention relates to movable blade assemblies for hair clippers and to means for supporting the movable blade assembly of a hair clipper against the lower blade such that the compression force and surface tension or friction between the movable blade assembly and the lower blade can be readily adjusted by the hair clipper operator. Still more particularly, the invention relates to arrangements for effecting such adjustment.

SUMMARY OF THE INVENTION

The invention provides a hair clipper blade set comprising a lower blade including a forward edge with a series of teeth extending therealong, upper and lower surfaces extending from the forward edge, and a threaded bore extending between the upper and lower surfaces, a movable upper blade including a forward edge with a series to teeth extending therealong, an upper surface, a lower surface supported by the upper surface of the lower blade, and means for supporting and biasing the upper blade against the lower blade for linear movement of the forward edge of the upper blade parallel to the forward edge of the lower blade, which supporting means includes a spring member comprising a forward portion including a forward end positionable against the upper surface of the movable blade, and a rear portion parallel to and spaced apart from the upper surface of the lower blade behind the movable upper blade and having therein an aperture, and a tension adjustment screw extending through the aperture, having an enlarged head engaging the spring member, and having an outer end releasably secured in the threaded bore, and further including, in the outer end, means facilitating rotation of the screw in the bore by manipulating a tool removably extending into the bore from the lower surface of the lower blade.

In one embodiment of the invention the means facilitating rotation of the tension adjustment screw comprises a recess in the outer end of the tension adjustment screw.

In one embodiment of the invention the recess is a diametric slot.

In one embodiment of the invention the recess is a non-circular socket.

In one embodiment of the invention the tension adjustment screw terminates inwardly of said outer surface of said shear plate.

Other features and advantages of the embodiments of the invention will become known by reference to the following description, to the appended claims, and to the drawings.

Figure 1:
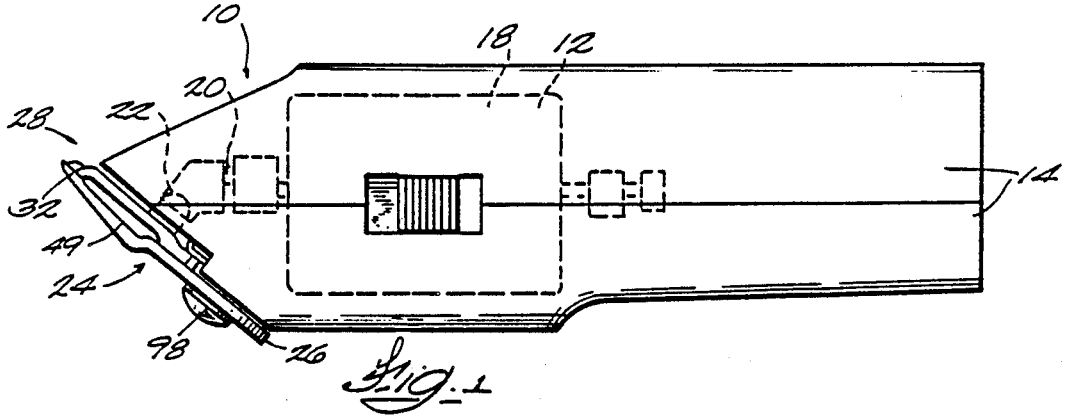
FIG. 1 is a side elevation view of a hair clipper embodying various of the features of the invention.

Before explaining a preferred embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Shown in the drawings is an electrical hair clipper 10 which embodies various of the features of the invention and which includes a housing 12 which is constructed of electrically insulating material, such as plastic. Any suitable design can be employed and, in the illustrated construction, the housing comprises two sections or parts 14 which are connected together. Located in the housing 12 is an electric motor 18 which can be of various designs but which, preferably, is an alternating current permanent magnet motor. In the specific construction illustrated, the electric motor 18 is generally arranged in the manner disclosed in U.S. Pat. No. 3,992,778, issued Nov. 23, 1976. The electrical motor 18 includes a drive shaft 20 extending from its ends, and an eccentric end portion 22 freely rotatable with respect to the drive shaft 20.

Figure 2:
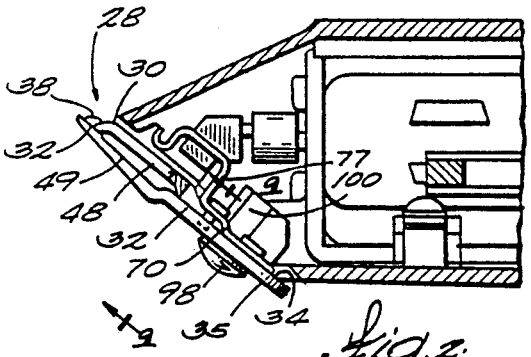
FIG. 2 is an enlarged side elevation view of the blade set and blade set mounting assembly of the hair clipper shown in FIG. 1.
Figure 3:
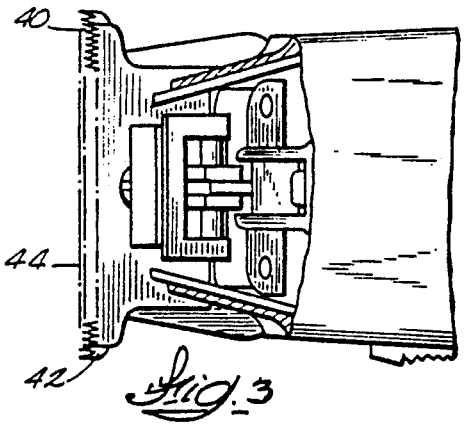
FIG. 3 is an enlarged top plan view showing the movable blade assembly drive arrangement for the blade set incorporated in the hair clipper shown in FIG. 1.
Figure 4:
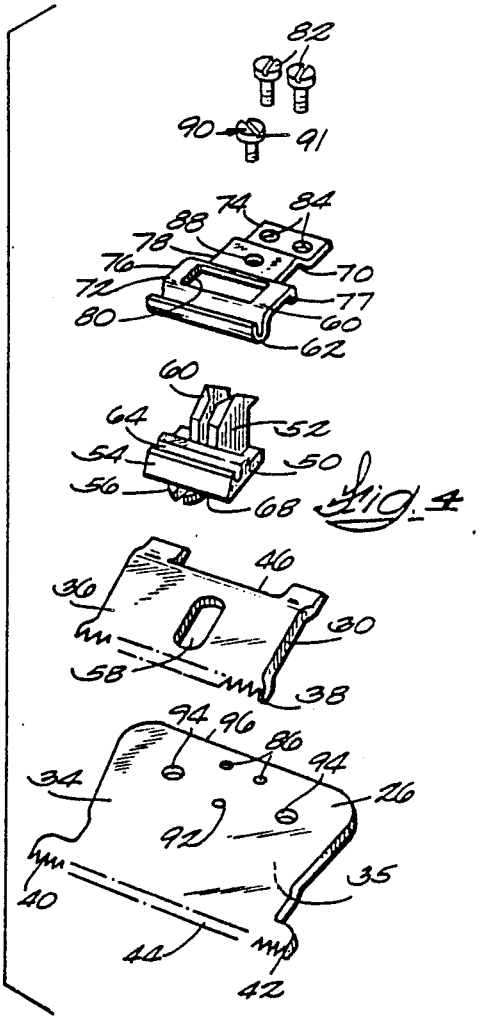
FIG. 4 is an exploded view of the blade set of the hair clipper shown in FIG. 1.

Located at one end of the housing 12 is a blade set 24 which includes a fixed lower blade or shear plate 26 which is connected to the housing 12 and which includes an upper surface 34 and an outer or lower surface 35. The blade set 24 also includes an upper movable blade, plate or comb assembly 28 which is reciprocable on and relative to the lower blade 26. In this last regard, the blade set 24 also includes suitable means for guiding reciprocation of the movable blade assembly 28 relative to the lower blade 26. Referring to FIG. 2, the movable blade assembly 28 includes a generally flat planar blade member or plate 30 which includes forwardly and rearwardly co-planar lower surfaces 32 which bear against the upper surface 34 of the lower blade 26. The planar blade member 30 also includes an upper surface 36, and a forward edge 38 with a series of teeth 40 (FIG. 3) cooperating with teeth 42 on the forward edge 44 of the lower blade 26.

The movable blade member 30 also includes an indented rearward edge or surface 46 which preferably extends in generally perpendicular relation to the upper surface 34. In the illustrated construction, the lower planar surfaces 32 are separated by a shallow groove 48 parallel to the forward and rearward edges of the movable blade member 30. The upper planar surface 34 of lower blade 26 similarly includes a transverse groove 49. The grooves 48 and 49 function to provide a recess between the lower blade 26 and the movable blade 30 to facilitate mating engagement of the cutting teeth 40 and 42. In an alternative construction, either or both of the grooves 48 and 49 could be deleted.

While the movable blade member 30 can be constructed in various ways, since the movable blade member 30 is planar and relatively thin, it can be conveniently manufactured by machining suitable hardened planar sheet stock.

The movable blade assembly 28 also includes means for engaging the eccentric end portion 22 of the motor drive shaft 20 such that rotation of the motor drive shaft 20 causes reciprocation of the movable blade assembly 28 with respect of the fixed blade 26 and for electrically insulating the movable blade assembly 28 from the motor drive shaft 20.

In this last regard, the movable blade 30 has fixedly extending therefrom an element which is driven by the drive shaft 20 and which is in the form of a yoke member 50 preferably constructed of an electrically insulating material, such as plastic. The yoke member 50 includes a U-shaped portion including first and second laterally spaced arms or walls 52 which extend upwardly from a main portion 54 in overlying engagement with the upper surface 36 of the upper blade 30. The main portion 54 includes a tab 56 located in a recess 58 in the upper blade 30.

Means are further provided for engaging the yoke arms 52 of the yoke member 50 and for causing transverse reciprocating movement of the movable blade assembly 28 to cause relative movement of the teeth 40 and 42. In the illustrated construction, the eccentric end portion 22 attached to the end of the motor drive shaft 20 extends between the yoke arms 52 for engagement therebetween. Rotation of the drive shaft 20 and consequent eccentric movement of the eccentric end portion 22 will thus cause reciprocating movement of the movable blade assembly 28. The eccentric end portion 22 is provided with a conical end such that the eccentric end portion is guided between the yoke arms 52 when the blade set 24 is attached to the housing 12.

Means are further provided for biasing the movable blade assembly 28 against the upper surface 34 of the lower blade 26 and for supporting the movable blade assembly 28 for reciprocating movement in a path generally parallel to the forward edge of the lower blade 26.

In the illustrated construction, such biasing means includes a resilient spring member 60 having a forward linear end or edge portion 62 positioned in a groove 64 in the upper surface 66 of the yoke member 50 of the movable upper blade assembly 28. The groove 64 is adjacent and parallel to the forward edge 68 of the yoke member 50.

The spring member 60 is comprised of thin generally planar spring metal and includes a downwardly extending offset 70 near the rear of the spring member 60. The offset 70 extends parallel to the forward linear edge portion 62. The offset 70 separates the spring member 60 into a forward portion 72 and a planar rear portion 74. The forward portion 72 includes a front planar part or portion 76 and a rear planar part or portion 78 which can also be considered an intermediate portion located between the front planar portion 76 and the planar rear portion 74. The rear planar portion 78 is parallel to but offset at 77 downwardly from the front planar portion 76. The offset 77 brings the rear planar portion 78 closer to the upper surface 34 of the lower blade 26.

The front planar portion 76 includes an opening 80 to receive the wall portions 52 of the yoke member 50. The opening 80 is large enough to permit reciprocal movement of the wall portions 52 in the opening 80.

The front planar portion 76 of the spring member also includes a downwardly bend edge portion forming the forward linear edge portion 62. The forward linear edge portion 62 is positioned in the groove 64 and is intended to exert a downward force on the yoke member 50 and the movable upper blade and to guide the movable upper blade 30 for reciprocal movement. To facilitate the reciprocal sliding movement of the yoke member 50 with respect to the spring member 60, the forward linear edge portion 62 includes a generally U-shaped edge conforming to the groove 64 in the yoke member 50.

The planar rearward portion 74 includes means for releasably securing the spring member to the lower blade. The securing means comprises two screws 82 received in a pair of apertures 84 in the planar rearward portion 74 in a line parallel to the forward linear edge portion 62 of the spring member 60. The screws 82 are secured in threaded bores 86 extending through the upper surface 34 of the lower blade 26. The securing means permits the easy removal of the removable upper blade assembly and the accurate realignment of the upper blade assembly when the blade set is reassembled.

The rear planar portion 78 of the forward portion 72 includes adjustable means for insuring the spring member 60 is under tension and exerts the appropriate downward force on the yoke member 50 and movable blade 30. This means includes an aperture 88 for receiving a tension adjustment screw 90 which includes an enlarged head 91 which, as shown, can be slotted to receive a standard screw driver. The adjustment screw 90 is secured in a threaded bore 92 extending completely through the lower blade or shear plate 26.

The distance of the forward portion 72 from the forward edge 62 to the rear edge adjacent the offset 70 is longer than the distance of the movable upper blade assembly 28 from the groove 54 to the rear 46 of the movable upper blade 30. As a result, the offset 70 in the spring member 60 is spaced behind the rear edge 46 of the movable upper blade 30. This results in the rear planar portion 78 of the forward portion 72 being behind the movable upper blade 30 and parallel to but spaced apart from the upper surface 34 of the lower blade 26.

The tension adjustment screw 90 can then be screwed or unscrewed so the spacing between the rear planar portion 78 and the upper surface 34 to the lower blade 26 can be increased or decreased. As a result, the hair clipper operator can adjust the amount of downward force exerted by the spring member 60 on the movable blade 30 and thus adjust the surface tension or friction between the upper blade 30 and the lower blade 26.

The apertures 84 and 88 in the spring member 60 are larger than the diameter of the screws 82 and 90 to facilitate adjustment of the position of the spring member 60 and consequent adjustment of the relative position of the movable blade assembly 28 and the lower blade 26.

The blade set 24 and Particularly the lower blade 26 is connected to the housing 12 by means permitting the releasable attachment of the blade set 24 on the hair clipper 10. In this embodiment, the connecting means includes a pair of apertures 94 near the rear end 96 of the lower blade 26. Connecting screws 98 are received in the apertures 94 and secured in threaded receiving means 100 connected to the housing 12.

As thus far disclosed, in order to adjusts the tension in the spring member 60, so as thereby to obtain access to the slotted head 91 of the screw 90, the blade set 24 is first removed from the housing 12 by unthreading the screws 82.

In order to avoid such disassembly of the blade set 24 from the housing 12 while, at the same time, facilitating adjustment of the tension in the spring member 60 by the adjustment screw 90, the screw 90 is provided with means accessible from adjacent the lower surface 35 of the fixed lower blade 26.

Figure 7:
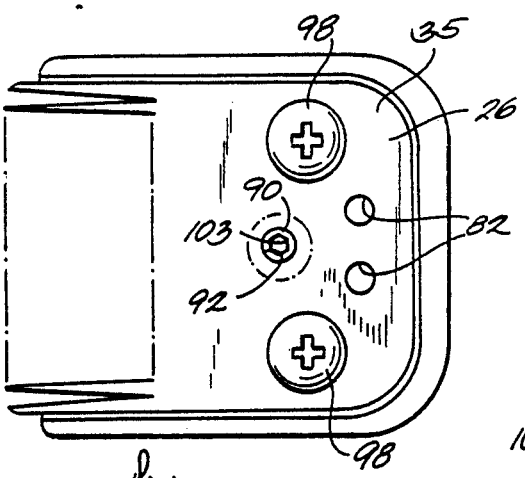
FIG. 7 is fragmentary view of the bottom of the shear plate of a second version of the hair clipper shown in FIG. 1.
Figure 8:
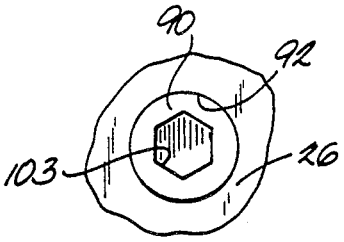
FIG. 8 is an enlarged view of the area circled in FIG. 7.
Figure 5:
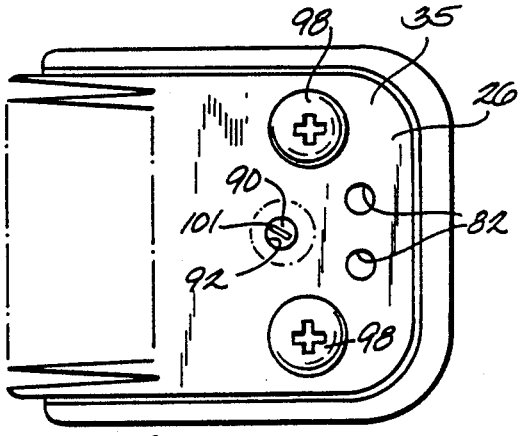
FIG. 5 is fragmentary view of the bottom of the shear plate of one version of the hair clipper shown in FIG. 1.
Figure 6:
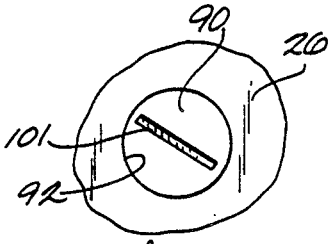
FIG. 6 is an enlarged view of the area circled in FIG. 5.
Figure 9:
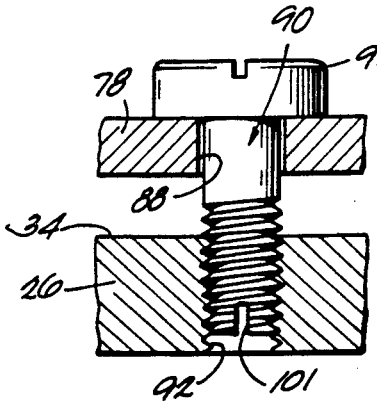
FIG. 9 is an enlarged fragmentary sectional view taken along line 9—9 of FIG. 2.

More specifically, such means includes means enabling or facilitating rotation of the screw 90 so as to axially displace the screw relative to the lower or shear plate 26. Still more particularly, such means can include, in the outer end of the screw 90, an axially extending recess, such as a diametric slot 101 which is shown in FIG. 5 and 6 and which is adapted to receive the chisel shaped end of a standard screw driver, or such as an axially extending socket 103 which is shown in FIGS. 7 and 8 and which, in a plane transverse to the axis of the screw 90, has a non circular cross-section, such as a square or hexigonal cross-section, which socket 103 is adapted to receive a suitably shaped key pr allen wrench to afford rotation of the screw 90 relative to the lower or shear plate 26 in order to adjust the tension on the spring member 60 in response to manipulation of the allen wrench or key.

As is apparent from the drawings, the screw 90 is dimensioned such that the lower end thereof is located, in all tension adjusting positions, within the bore 92, i.e., the lower end of the screw 90 does not project beyond the lower or outer surface 35 of the shear plate 26. Accordingly, the use of the screw 90 with the recess 101 or 103 in the outer end thereof facilitates adjustment of the spring member 60 when the blade set 24 is fixed on the housing 12.

Various of the features of the invention are set forth in the following claims.

I claim:

1. A hair clipper blade set comprising a lower blade including a forward edge with a series of teeth extending therealong, upper and lower surfaces extending from said forward edge, and a threaded bore extending between said upper and lower surfaces, a movable upper blade including a forward edge with a series of teeth extending therealong, an upper surface, and a lower surface supported by said upper surface of said lower blade, and means for supporting and biasing said upper blade against said lower blade for linear movement of said forward edge of said upper blade parallel to said forward edge of said lower blade, said supporting means including a spring member comprising a forward portion including a forward end positionable against said upper surface of said movable blade, a rear portion parallel to said upper surface of said lower blade, and an intermediate portion extending between said forward portion and said rear portion and parallel to and spaced apart from said upper surface of said lower blade behind said movable upper blade and having therein an aperture, means for fixing said rear portion to said lower blade, and a tension adjustment screw extending through said aperture, having an enlarged head engaging said spring member, and having an outer end releasably secured in said threaded bore, and further including, in said outer end, means facilitating rotation of said screw in said bore by manipulating a tool removably extending into said bore from said lower surface of said lower blade.

2. A hair clipper blade set in accordance with claim 1 wherein said means facilitating rotation of said tension adjustment screw comprises a recess in said outer end of said tension adjustment screw.

3. A hair clipper blade set in accordance with claim 2 wherein said recess is a diametric slot.

4. A hair clipper blade set in accordance with claim 2 wherein said recess is a non-circular socket.

5. A hair clipper in accordance with claim 2 wherein said tension adjustment screw terminates inwardly of said lower surface of said lower blade.

* * * * *